United States Patent [19]

Ogawa et al.

[11] Patent Number: 4,894,927

[45] Date of Patent: Jan. 23, 1990

[54] PROCESS FOR DRYING COATED WEB

[75] Inventors: Masaharu Ogawa; Takao Ogawa, both of Shizuoka, Japan

[73] Assignee: Fuji Photo Film Co., Ltd., Minami-Ashigara, Japan

[21] Appl. No.: 136,122

[22] Filed: Dec. 21, 1987

[30] Foreign Application Priority Data

Dec. 23, 1986 [JP] Japan ..... 61-305266

[51] Int. Cl.[4] ..... F26B 3/32

[52] U.S. Cl. ..... 34/32; 34/36; 34/41

[58] Field of Search ..... 34/86, 85, 23, 33, 76, 34/26, 28, 32, 72, 36, 37, 16, 40, 41

[56] References Cited

U.S. PATENT DOCUMENTS

| | | | |
|---|---|---|---|
| 1,613,073 | 1/1927 | Zimmerli | 34/40 |
| 4,135,098 | 1/1979 | Troue | 34/41 X |
| 4,240,453 | 12/1980 | Vail et al. | 34/77 X |
| 4,654,980 | 4/1987 | Bhat | 34/23 X |

*Primary Examiner*—Henry A. Bennet

*Attorney, Agent, or Firm*—Burns, Doane, Swecker & Mathis

[57] ABSTRACT

A process for drying a moving web coated with a coating composition containing an inflammable organic solvent which comprises, drying said coated web by passing it through a closed-type oven filled with an inert gas and provided with planar heaters on the upper side and lower side of the path of the moving web, and separating said organic solvent from the exhaust gas of said oven by condensation. The process of the invention does not require air for dilution or an incinerator. Moreover, the recycle volume of inert gas is small, and the heat exchanger is compact. Accordingly, the whole apparatus can be made compact. The coated face of web is hardly affected by the movement of the surrounding atmosphere due to the drying by heaters as well as the small volume of inert gas introduced into the oven. Accordingly, a uniformly dried coating can be obtained.

5 Claims, 1 Drawing Sheet

PROCESS FOR DRYING COATED WEB

BACKGROUND OF THE INVENTION

1. Field of the Invention

This invention relates to a process for drying a coated web such as a photographic photosensitive material.

2. Description of Prior Art

Various photographic photosensitive materials and other materials are manufactured by drying a continuous web such as a plastic support or a paper support on which one or more coating compositions are applied. This composition is generally produced by dissolving or dispersing prescribed components in an organic solvent. The coated web is dried by blowing hot air or by irradiation with infrared light. In such drying methods, when the concentration of the organic solvent vapor becomes high, an explosion occurs. Therefore, a large quantity of air was introduced into the oven, and thereby the concentration of the organic solvent vapor was controlled so as to be kept lower than one third of the explosion limit. As a result, a lot of thermal energy was consumed for heating of the air for dilution and for incineration of a large amount of the exhaust gas, in addition to the energy required for the evaporation of the solvent. Various investigations for solving this problem have been made, and for example, recovery of heat of the exhaust gas by using a heat exchanger and a method of using water as the solvent have been proposed.

On the other hand, it is known that, in the drying process of a continuous coating on a metallic strip, an explosion of a solvent is prevented by blowing a hot inert gas into an oven and thereby the air for dilution is not added (U.S. Pat. No. 3,909,953). In this method, the exhaust gas is mixed with air, and the organic solvent in the gas is incinerated to produce an inert gas. The heat of the inert gas is utilized for the drying of the metallic strip by returning the incinerated gas into the oven, and excess heat is recovered by a heat exchanger and utilized.

In the recovery of heat of the exhaust as by using a heat exchanger, the yield of heat recovery is usually only about 50 to 60%. The cost of equipment is expensive, because a big heat exchanger is necessary. In the method of using water as the solvent, consumption of thermal energy is increased by evaporating the water. In the foregoing method to incinerate the exhaust gas, the cost of equipment is expensive, because a big incinerator and heat exchanger are necessary. It is also a problem that the whole amount of the valuable organic solvent is incinerated.

SUMMARY OF THE INVENTION

An object of the invention is to provide a process for drying a moving web coated with a coating composition containing an inflammable organic solvent which does not require air for dilution or an incinerator.

Another object of the invention is to provide a process for drying a moving web coated with a coating composition containing an inflammable organic solvent allowing the whole drying apparatus to be compact and capable of saving thermal energy.

Another object of the invention is to provide a process for drying a moving web coated with a coating composition containing an inflammable organic solvent capable of producing an uniformly coated web.

Still another object of the invention is to provide a process for drying a moving web coated with a coating composition containing an inflammable organic solvent capable of recovering the organic solvent in a high yield.

The inventors have conduct an investigation to achieve such objects, and they have devised a drying means comprising heating both faces of the moving web by heaters in an inert atmosphere and separating the organic solvent from the exhaust gas of a drying oven. They have found that by using this means, the blowing amount of inert gas can be minimized, and the drying oven and the heat exchanger for recovering solvent can be made compact. Moreover, they have found that various advantages are obtained by using this means, such as not requiring a incinerator, the saving of thermal energy, the production of a uniformly coated web, the recovery of the organic solvent in a high yield, and the like.

Thus, the present invention provides a process for drying a moving web coated with a coating composition containing an inflammable organic solvent which comprises, drying said coated web by passing the web through a closed-type oven filled with an inert gas and provided with planar heaters on the upper side and lower side of the path of the moving web, and separating said organic solvent from the exhaust gas of said oven by condensation.

DETAILED DESCRIPTION OF THE INVENTION

Figure 1:
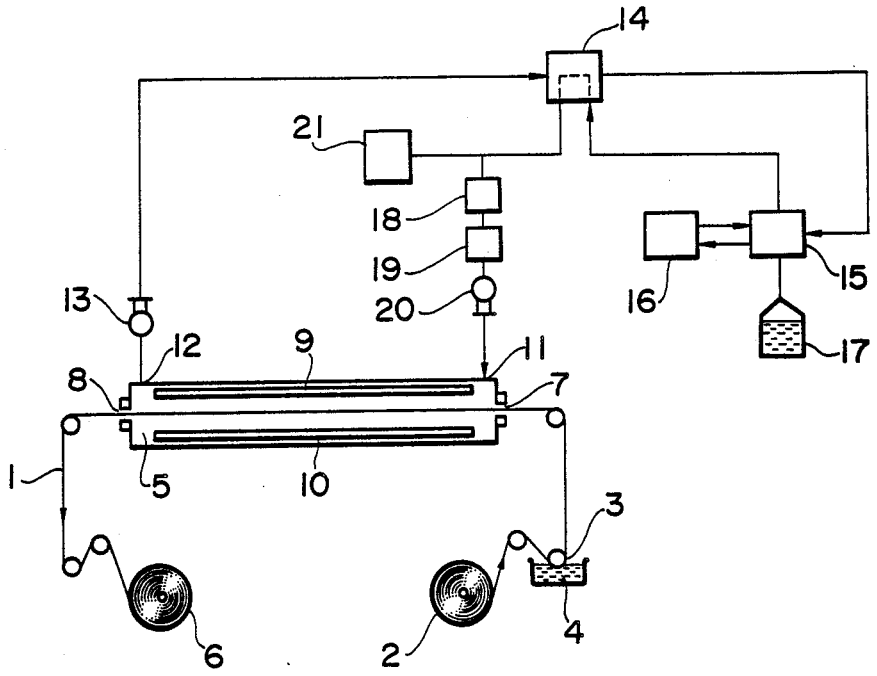
FIG. 1 is a flow chart indicating a drying apparatus utilized in the process of the invention.

The inflammable organic solvent includes benzene, toluene, an alcohol such as methanol, a ketone such as acetone and methyl ethyl ketone, methyl acetate and methylene glycol.

The drying oven should be closed-type in order to keep its inside filled with an inert gas. The inert gas is able to prevent combustion, and includes nitrogen gas and carbon dioxide gas. An entrance and an exit for the passage of the coated web should be provided to the drying oven. Both openings are usually slit-shape. An inlet port and an exhaust port for the inert gas are also necessary. Additionally, straightening vanes, baffle plates, etc. may be provided.

The drying oven is provided with the planer heaters on the upper side and lower side of the path of a moving web. The heaters heat the moving web preferably so as to evaporate the organic solvent uniformly in the transverse direction. The kind of the heater is not limited, and includes the heaters utilizing a heat medium such as oil, water vapor or melted metal and electric heater. The heating face of the heater is planar, usually square, and the heater may be an aggregate of line heaters. The size, capacity, mounting position and the like of the heater are decided by considering the kind of web, the kind of organic solvent, operating conditions, and the like. The temperature of the heater is set so as to dry the coated web up to a prescribed value, and it is affected by the kind, size and moving speed of the coated web, the kind of organic solvent, the volume of inert gas introduced into the oven, and the like. The volume of inert gas is set so as to keep the organic solvent concentration of the exhaust gas constant, and it is also affected by the kind, size and moving speed of the coated web, the kind of organic solvent, the temperature of the heater, and the like.

The drying oven is provided with a blower for blowing inert gas in the oven and an exhaust blower. According to the size of the oven, one of the blowers may be excluded.

The exhaust gas contains organic solvent vapor in a high concentration, and accordingly, the organic solvent is recovered by a condenser for reuse. The inert gas is then returned to the oven.

In order to save thermal energy, a heat exchanger is preferably provided between the condenser and the oven. Thereby, the exhaust gas is precooled, and the inert gas discharged from the condenser is preheated.

As explained heretofore, the drying apparatus utilized in the invention is substantially closed type, and it has a recycle line for inert gas.

In the drying process of the invention, the volume of inert gas necessary to maintain organic solvent vapor concentration constant may be small. Therefore, the pressure difference between the inside and outside of the oven is small, and the oven can readily be sealed so that inert gas does not leak. The process of the invention does not require air for dilution or an incinerator. Moreover, the circulating volume of inert gas is small, and the heat exchanger is compact. Accordingly, the whole apparatus can be made compact. The coated face of the web is hardly affected by the movement of the surrounding atmosphere due to the drying by heaters as well as the small volume of inert gas introduced into the oven. Uniformly dried coating can be obtained with small influences of the movement of the atmosphere and the heating from both sides of the web. The organic solvent is recovered in a high yield, and it can be reused or used for other purposes.

EXAMPLE

The apparatus illustrated in FIG. 1 is an example utilized in the process of the invention.

As shown in the drawing, a web 1 is unwound from its roll 2, and is applied with a coating composition 4 by a well known coating apparatus 3. The coated web 1 is dried during passage through a drying oven 5, and wound on a roll 6.

Figure 2:
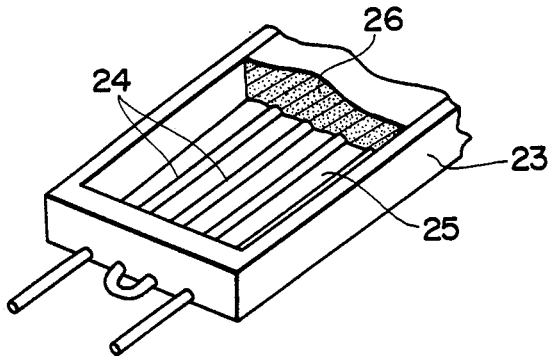
FIG. 2 is a perspective view, partly broken away to show radiating pipes and fins, of a planar heater.

The drying oven 5 is closed-type and long box-shape. An entrance 7 and an exit 8 for the passage of the coated web 1 are open on both ends in the longitudinal direction. Both openings 7, 8 are slit-shape. The drying oven 5 is provided with planar heaters 9, 10 on its inside located on the upper side and lower side of the path of the web 1, respectively. The heaters 9, 10 are, as shown in FIG. 2, composed of a frame 23, radiating pipes 24, fins 25 and heat-insulating material 26. The radiating pipe 24 is joined to a heat medium-circulating apparatus (not illustrated) composed of heater, circulating pump and the like, and a heat medium flows in it. The radiating pipe 24 is heated by the heat medium, and the heat is transferred to the fins 25. According to drying conditions, the fins 25 and the heat-insulating material 26 can be eliminated.

An inlet port 11 and an exhaust port 12 for an inert gas are provided on the upper face of the oven 5. The exhaust port 12 is connected to a condenser 15 through an exhaust blower 13 and a heat exchanger 14. A cooling device 16 is connected to supply a refrigerant to the condenser 15, and the condensed solvent is received by a receiver 17. The outlet of the condenser 15 is connected to the inlet port 11 through the heat exchanger 14, a dust filter 18, a heater 19 and a blower 20 to form a circuit of the inert gas. An inert gas supplying apparatus 21 is connected to this circuit between the outlet of the hat exchanger 14 and the dust filter 18.

In this drying apparatus, the web 1 is unwound from the roll 2, and applied with the coating composition 4 by the coating apparatus 3. The coated web 1 moves through the inside of the oven 5 filled with the inert gas, and it is gradually dried by the heat radiated from the heaters 9, 10. The coated web 1 goes out of the oven 5 in a completely dried state, and is wound on the roll 6. The organic solvent evaporated by the drying is sucked out by the exhaust blower 13, and discharged from the exhaust port 12 together with the inert gas. The discharged gas is precooled by the heat exchanger with the discharged gas of the condenser 15 in the heat exchanger 14, and further cooled to condense the organic solvent in the condenser 15. The discharged gas of the condenser 15 is preheated in the heat exchanger 14, and any shortage of the inert gas is met by supplying fresh inert gas from supplying apparatus 21. Any dust accompanying the gas is removed by the dust filter 18, and the gas is heated by the heater 19 up to a prescribed temperature. Thus, the inert gas is returned into the oven 5 by the blower 20.

A photosensitive diazo compound, a photo-polymerizable composition and other compounds were dissolved in acetone to produce a coating composition 4. A polyethylene terephthalate film was employed as the support, and the above coating composition 4 was applied on it to form a coated web 1. This coated web 1 was dried using the apparatus of FIG. 1. Nitrogen gas was employed as the inert gas, and its temperature was set at 60° C. at the inlet port 9. The temperature of both planar heaters 9, 10 were set at 200° C. As a result of the operation, 90% of the acetone contained in the exhaust gas was recovered by the condenser 15. The coated web was completely dried, and its quality was uniform. The drying was continued without any trouble.

We claim:

1. A process for drying a moving web coated with a coating composition containing an inflammable organic solvent which comprises, drying said coated web by passing through a closed-type oven filled with an inert gas and provided with planar heaters on the upper side and lower side of the path of the moving web so as to heat the web and evaporate organic solvent thereby forming an exhaust gas comprised of said inert gas and said evaporated organic solvent, removing the exhaust gas from the closed-type oven, and separating said organic solvent from the exhaust gas of said oven by condensation.

2. The process of claim 1 wherein said exhaust gas after separating the organic solvent is returned to said oven.

3. The process of claim 2 wherein the exhaust gas after the condensation is heated by the heat contained in the exhaust gas of said oven.

4. The process of claim 1 wherein said coated web is a photographic photosensitive material.

5. The process of claim 1, wherein said organic solvent is a member selected from the group consisting of benzene, toluene, methanol, acetone, methyl ethyl ketone, methyl acetate and methylene glycol.

* * * * *